United States Patent [19]

Patmore et al.

[11] 4,370,221

[45] Jan. 25, 1983

[54] CATALYTIC HYDROCRACKING OF HEAVY OILS

[75] Inventors: David J. Patmore; Ramaswami Ranganathan; Chandra P. Khulbe, all of Ottawa; Barry B. Pruden, Calgary, all of Canada

[73] Assignee: Her Majesty the Queen in right of Canada, as represented by the Minister of Energy, Mines and Resources, Ontario, Canada

[21] Appl. No.: 240,089

[22] Filed: Mar. 3, 1981

[51] Int. Cl.[3] ..... C10G 47/04

[52] U.S. Cl. ..... 208/112; 208/48 R; 208/59

[58] Field of Search ..... 208/112, 48 R, 10, 251 H

[56] References Cited

U.S. PATENT DOCUMENTS

| | | | |
|---|---|---|---|
| 2,939,835 | 6/1960 | Varga et al. | 208/108 |
| 3,151,057 | 9/1964 | Schuman et al. | 208/111 |
| 3,775,296 | 11/1973 | Chervenak et al. | 208/108 |
| 3,844,937 | 10/1974 | Wolk | 208/108 |
| 3,849,292 | 11/1974 | Gleim | 208/111 |
| 4,176,051 | 11/1979 | Ternan et al. | 208/112 |
| 4,196,072 | 4/1980 | Aldridge et al. | 208/108 X |
| 4,214,977 | 7/1980 | Ranganathan et al. | 208/108 |
| 4,279,736 | 7/1981 | Gleim | 208/39 |
| 4,298,454 | 11/1981 | Aldridge et al. | 208/108 X |
| 4,299,685 | 11/1981 | Khulbe et al. | 208/108 X |

FOREIGN PATENT DOCUMENTS

| | | | |
|---|---|---|---|
| 1073389 | 11/1980 | Canada | 208/108 |

*Primary Examiner*—Patrick Garvin
*Assistant Examiner*—G. E. Schmitkons
*Attorney, Agent, or Firm*—Finnegan, Henderson, Farabow, Garrett & Dunner

[57] ABSTRACT

An improved process is described for the hydrocracking of heavy hydrocarbon oil, such as oils extracted from tar sands. The charge oil in the presence of an excess of hydrogen is passed through a tubular hydrocracking zone, and the effluent emerging from the top of the zone is separated into a gaseous stream containing a wide boiling range material and a liquid stream containing heavy hydrocarbons. According to the novel feature, the hydrocracking process is carried out in the presence of a catalyst consisting of finely divided coal or other carbonaceous material carrying catalytically active metals from Group VIA and Group VIII of the Periodic Table of Elements, e.g. cobalt and molybdenum. The catalyst is slurried with the charge stock and has been found to greatly reduce coke precursors and thereby prevent the formation of carbonaceous deposits in the reaction zone while also being effective in reducing the sulfur concentration of the product.

7 Claims, 1 Drawing Figure

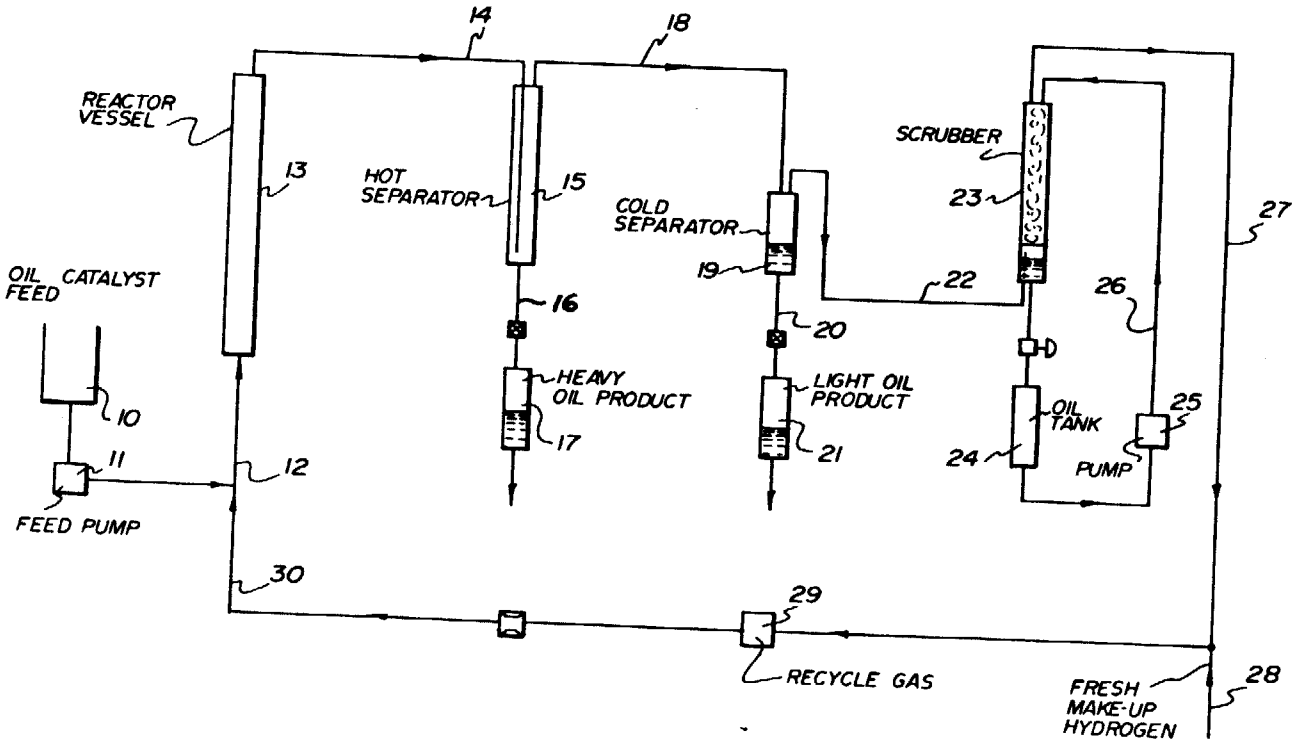
REACTOR VESSEL
13
OIL FEED
CATALYST
10
11
FEED PUMP
12
30
HOT SEPARATOR
14
15
16
HEAVY OIL PRODUCT
17
18
COLD SEPARATOR
19
20
LIGHT OIL PRODUCT
21
22
SCRUBBER
23
24
OIL TANK
PUMP
25
26
27
28
FRESH MAKE-UP HYDROGEN
29
RECYCLE GAS

CATALYTIC HYDROCRACKING OF HEAVY OILS

This invention relates to the treatment of hydrocarbon oils and, more particularly, to the hydrocracking of heavy hydrocarbon oils to produce improved products of lower boiling range.

Hydrocracking processes for the conversion of heavy hydrocarbon oils to light and intermediate naphthas of good quality for reforming feed stocks, fuel oil and gas oil are well known. These heavy hydrocarbon oils can be such materials as petroleum crude oil, atmospheric tar bottoms products, vacuum tar bottoms products, heavy cycle oils, shale oils, coal derived liquids, crude oil residuum, topped crude oils and the heavy bituminous oils extracted from oil sands. Of particular interest are the oils extracted from oil sands and which contain wideboiling range materials from naphthas through kerosene, gas oil, pitch, etc. and which contain a large portion of material boiling above 524° C.

The heavy hydrocarbon oils of the above type tend to contain nitrogen and sulphur compounds in large quantities. In addition, such heavy hydrocarbon fractions frequently contain excessive quantities of organo-metallic contaminants which tend to be detrimental to various catalytic processes that may subsequently be carried out, such as hydrofining. Of the metallic contaminants, those containing nickel and vanadium are most common, although other metals are often present. These metallic contaminants, as well as others, are usually present within the bituminous material as organo-metallic compounds of relatively high molecular weight. A considerable quantity of the organo-metallic complexes are linked with asphaltenic material and contain sulphur. Of course, in catalytic hydrocracking procedures, the presence of large quantities of asphaltenic material and organic-metallic compounds interferes considerably with the activity of the catalyst with respect to the destructive removal of nitrogen, sulphur and oxygen compounds. A typical Athabasca bitumen may contain 53.76 wt. % material boiling above 524° C., 4.74 wt. % sulphur, 0.59 wt. % nitrogen, 162 ppm vanadium and 72 ppm nickel.

As the reserves of conventional crude oils decline, these heavy oils must be upgraded to meet the demands. In this upgrading, the heavier material is converted to lighter fractions and most of the sulphur, nitrogen and metals must be removed. This can be done either by a coking process, such as delayed or fluidized coking, or by a hydrogen addition process, such as thermal or catalytic hydrocracking. The distillate yield from the coking process is about 70 wt. % and this process yields up to 23 wt. % coke as a by-product which cannot all be used as fuel because of low H/C ratio, high mineral and sulphur content. This loss of coke represents an excessive waste of natural resources. Depending on operating conditions, hydrogenation processes can give a distillate yield of over 87 wt. %.

Recent work has been done on an alternate processing route involving hydrogen addition at high pressures and temperatures and this has been found to be quite promising. In this process, hydrogen and heavy oil are pumped upwardly through an empty tubular reactor in the absence of any catalyst. It has been found that the high molecular weight compounds hydrogenate and/or hydrocrack into lower boiling ranges. Simultaneous desulphurization, demetallization and denitrogenation reactions take place. Reaction pressures up to 3500 psig. and temperatures up to 490° C. have been employed.

In thermal hydrocracking, the major problem is coke or solid deposition in the reactor, especially when operating at relatively low pressures, and this can result in costly shut-downs. Deposits form at the top of the reactor where the partial pressure of hydrogen and the ash content are at the lowest. Higher pressures reduce reactor fouling. At 3500 psig. and 470° C., the coke deposition can be substantially eliminated. However, plant operations at high pressures involve higher capital and operating costs.

It has been well established that mineral matter present in the feed stock plays an important role in coke deposition. Chervenak et al U.S. Pat. No. 3,775,296 shows that feed stock containing high mineral content (3.8 wt. %) had less tendency to form coke in the reactor than feed containing low mineral matter (<1 wt. %). Other studies have shown that a high mineral content had no apparent effect on pitch conversion and desulphurization, but suppressed coke deposition in the reactor and general reaction fouling.

It has also previously been shown that coke deposition in the reactor can be suppressed by recirculating a portion of heavy ends to the lower portion of the reaction zone. In Wolk, U.S. Pat. No. 3,844,937 it has been shown that when the mineral concentration of the reactor fluid was maintained between 4 and 10 wt. % during thermal hydrocracking, no coke was found in the reactor. It seemed that during the hydrocracking process, carbonaceous material deposited on solid particles instead of the reactor wall, and could thus be carried out with the reactor effluent. This indicated the possibility of continuously adding and withdrawing a coke carrier in the reactor.

The addition of coke carriers was proposed in Schuman et al. U.S. Pat. No. 3,151,057, who suggested the use of "getters" such as sand, quartz, alumina, magnesia, zircon, beryl or bauxite. These "getters" could be regenerated after use by heating the fouled carrier with oxygen and steam at about 1090° C. to yield regeneration-product-gases containing a substantial amount of hydrogen.

The use of coal as a "getter" has been described in Ternan et al Canadian Pat. No. 1,073,389 issued Mar. 1, 1980, and it was observed that coal particles were able to accumulate metals and any coke formed during the hydrocracking process.

It is also known from Varga et al U.S. Pat. No. 2,939,835 that asphalt containing oils can be hydrocracked in the presence of catalysts comprising iron oxides dispersed on coke or carbon powder. The Ranganathan et al. Canadian application Ser. No. 289,320, filed Oct. 24, 1977 (now U.S. Pat. No. 4,214,977) describes the use of coal with iron sulfate additive to inhibit coke formation. It is further known from Gleim U.S. Pat. No. 3,849,292 to hydrocrack heavy hydrocarbon charge stocks in the presence of a catalytic composite of a porous alumina-containing carrier material and metal components from Groups IV, V and VI.

It is the object of the present invention to overcome the problems of deposits forming in the reactor during the hydrocracking process, with simultaneous reduction of the sulphur concentration of the product.

SUMMARY OF THE INVENTION

In accordance with the present invention, there is described a process for hydrocracking a heavy hydrocarbon oil, a substantial portion of which boils above 524° C. which comprises:

(a) passing a slurry of said heavy hydrocarbon oil and a catalyst comprising finely divided carbonaceous material carrying one or more metals of Group VIA or VIII of the Periodic Table in the presence of 500–50,000 scf of hydrogen per barrel of said hydrocarbon oil through a confined hydrocracking zone, said hydrocracking zone being maintained at a temperature between about 400° and 500° C., a pressure of at least 500 psig and a space velocity between about 0.5 and 4 volumes of hydrocarbon oil per hour per volume of hydrocracking zone capacity, (b) removing from said hydrocracking zone a mixed effluent containing a gaseous phase comprising hydrogen and vaporous hydrocarbons and a liquid phase comprising heavy hydrocarbons, and (c) separating said effluent into a gaseous stream containing hydrogen and vaporous hydrocarbons and a liquid stream containing heavy hydrocarbons.

This process substantially prevents the formation of carbonaceous deposits in the reaction zone. These deposits, which may contain insoluble organic material, mineral matter, metals, sulphur, quinoline and benzene soluble organic material will hereinafter be referred to as "solids" or "coke" deposits. The process also has been highly effective in reducing the sulphur concentration of the product. Particularly surprisingly, it has been found that a sub-bituminous coal containing cobalt and molybdenum is a more effective catalyst for coke prevention than is coal containing cobalt, molybdenum and alumina.

The process of this invention is particularly well suited for the treatment of heavy oils having a large proportion, preferably at least 50% by volume, which boils above 524° C. and which contains a wide boiling range of materials from naphtha through kerosene, gas oil and pitch. It can be operated at quite moderate pressure, preferably in the range of 500 to 3500 psig., without coke formation in the hydrocracking zone.

Although the hydrocracking can be carried out in a variety of known reactors of either up or down flow, it is particularly well suited to a tubular reactor through which it is moved upwardly. The effluent from the top is preferably separated in a hot separator and the gaseous stream from the hot separator can be fed to a low temperature-high pressure separator where it is separated into a gaseous stream containing hydrogen and lesser amounts of gaseous hydrocarbons and a liquid product stream containing light oil product.

The catalyst used in accordance with this invention is preferably of quite small particle size, e.g. less than 100 mesh (Canadian Standard Sieve) and the metal component is preferably cobalt and/or molybdenum compound. A typical catalyst will contain 0.2 to 10% by weight cobalt salt on coal (dry basis) and 0.4 to 20% by weight molybdenum salt on coal (dry basis) and usually this catalyst is mixed with the heavy oil feed in an amount of 0.1–5 wt. % based on heavy oil feed, preferably about 1 wt. %.

The coal used is preferably a sub-bituminous coal, e.g. Whitewood sub-bituminous B. This coal in finely divided form is treated with aqueous solutions of cobalt and molybdenum salt and then dried before blending with the feed stock. The mixing of the catalyst with the bitumen or heavy oil should be done carefully to prevent any formation of lumps.

Typically, a 10 to 50% slurry of catalyst with oil is prepared and is fed into the vertical reactor together with additional oil feed and hydrogen. The liquid-gas mixture from the top of the hydrocracking zone is separated in a hot separator kept between 350° C.–400° C. and at the pressure of the hydrocracking reaction. The heavy hydrocarbon oil product from the hot separator can either be recycled or sent to secondary treatment.

The gaseous stream from the hot separator containing a mixture of hydrocarbon gases and hydrogen is further cooled and separated in a low temperature-high pressure separator. By using this type of separator, the outlet gaseous stream obtained contains mostly hydrogen with some impurities such as hydrogen sulphide and light hydrocarbon gases. This gaseous stream is passed through a scrubber, and the scrubbed hydrogen is recycled as part of the hydrogen feed to the hydrocracking process. The recycled hydrogen gas purity is maintained by adjusting scrubbing conditions and by adding make-up hydrogen.

The liquid stream from the low temperature-high pressure separator represents the light hydrocarbon oil product of the present process and can be sent for secondary treatment. This product is normally let down in pressure using a two-stage system with provisions for dissolving gas handling from each stage.

At the start of the process the catalyst tends to accumulate in the reactor system. This stabilizes after a few days of operation and the catalyst is then carried over with the heavy oil product and is found in the +524° C. pitch fraction. If the pitch is subsequently gasified or burned, the cobalt and molybdenum can be recovered from the ash together with vanadium and nickel from the feed, or the solids can be separated from the heavy oil prior to separation of pitch by a suitable technique such as centrifugation. Alternatively, the catalyst can be concentrated in a cyclone separator or similar device, and the catalyst recycled to the reactor.

For a better understanding of the invention, reference is made to the accompanying drawing which illustrates diagrammatically a pilot unit for carrying out the present invention.

Heavy hydrocarbon oil feed and catalyst are mixed together in a feed tank 10 to form a slurry. This slurry is pumped via feed pump 11 through inlet line 12 into the bottom of an empty tower 13. Recycled hydrogen and make up hydrogen from line 30 is simultaneously fed into the tower 13 through line 12. A gas-liquid mixture is withdrawn from the top of the tower through line 14 and introduced into a hot separator 15. In the hot separator the effluent from tower 13 is separated into a gaseous stream 18 and a liquid stream 16. The liquid stream 16 is in the form of heavy oil which is collected in vessel 17 and contains carried over catalyst.

According to an alternative feature, a branch line is connected to line 16. This branch line connects through a pump into inlet line 12, and serves as a recycle for recycling the liquid stream containing carried over catalyst from hot separator 15 back into the feed slurry to tower 13.

In yet another embodiment, the line 16 feeds into a cyclone separator which separates the catalyst from the liquid stream. The separated catalyst is recycled into the feed slurry to tower 13, while the remaining liquid is collected in vessel 17.

The gaseous stream from hot separator 15 is carried by way of line 18 into a high pressure-low temperature separator 19. Within this separator the product is separated into a gaseous stream rich in hydrogen which is drawn off through line 22 and an oil product which is drawn off through line 20 and collected at 21.

The hydrogen rich stream 22 is passed through a packed scrubbing tower 23 where it is scrubbed by means of a scrubbing liquid 24 which is cycled through the tower by means of pump 25 and recycle loop 26. The scrubbed hydrogen rich stream emerges from the scrubber via line 27 and is combined with fresh make up hydrogen added through line 28 and recycled through recycle gas pump 29 and line 30 back to tower 13.

It will be appreciated that the feed slurry system described above is suited to a pilot unit and that for a commercial installation the catalyst is preferably mixed with a portion of the feed oil or other oil to form a 10–50% slurry. This slurry is then fed into a lower region of the reactor along with oil feed and hydrogen. It may also be desirable to provide an outlet at the bottom of the reactor to withdraw catalyst from the reactor as needed.

Certain preferred embodiments of this invention will now be further illustrated by the following non-limitative examples.

EXAMPLE 1

A series of pilot plant studies were carried out in a one barrel per day pilot plant of the type shown in the attached drawing. The tests were conducted using a bitumen feed stock having the properties shown in Table 1 below.

TABLE 1

| PROPERTIES OF BITUMEN FEEDSTOCK | | |
|---|---|---|
| Specific gravity | 15/15° C. | 1.013 |
| Sulphur | wt. % | 4.74 |
| Nitrogen | wt. % | 0.59 |
| Ash | wt. % | 0.59 |
| Viscosity at 99° C. | cst | 213 |
| Conradson Carbon Residue | wt. % | 14.9 |
| Pentane insolubles | wt. % | 16.8 |
| Benzene insolubles | wt. % | 0.52 |
| Nickel | ppm (wt) | 72 |

TABLE 1-continued

| PROPERTIES OF BITUMEN FEEDSTOCK | | |
|---|---|---|
| Vanadium | ppm (wt) | 162 |
| Pitch content | wt. % | 53.76 |
| Sulphur in 524° C.$^-$ dist. | wt. % | 2.96 |
| Sulphur in 524° C.$^+$ pitch | wt. % | 6.18 |

A catalyst was prepared by treating a −100 mesh Whitewood sub-bituminous B coal with aqueous solutions of cobalt and molybdenum salts. This was then dried to provide a catalyst consisting of 2% cobalt-molybdenum in a ratio of 1 part cobalt to 4 parts molybdenum by weight supported on coal.

For the sake of comparison, 6 different runs were made, one with no additive, one with coal as an additive, two with an additive consisting of coal containing cobalt, molybdenum and alumina and two with a catalyst of the present invention. The coal containing cobalt, molybdenum and alumina was 85% coal and 15% catalyst, with the catalyst being 15% of a Co,Mo mixture in the ratio of Co:Mo of 1:4 by weight and 85% $Al_2O_3$. All were run at the same operating conditions as set out in Table 2 below:

TABLE 2

| HYDROCRACKING OPERATING CONDITIONS | | | | | | |
|---|---|---|---|---|---|---|
| | Case 1 | Case 2 | Case 3 | Case 4 | Case 5 | Case 6 |
| Additive | Nil | Coal | Co-Mo-Al-Coal | Co-Mo-Al-Coal | Co-Mo-Coal | Co-Mo-Coal |
| Additive wt. % | — | 1 | 2 | 0.5 | 2 | 0.5 |
| Pressure, MPa | 13.89 | 13.89 | 13.89 | 13.89 | 13.89 | 13.89 |
| Reactor Temp. °C. | 460 | 460 | 460 | 460 | 460 | 460 |
| LHSV | 2 | 2 | 2 | 2 | 2 | 2 |
| $H_2$ rate, l/h (at 15° C. and 13.89 MPa) | 42.5 | 42.5 | 42.5 | 42.5 | 42.5 | 42.5 |
| Length of run, h. | 455 | 507 | 265 | 240 | 245 | 259 |

The pilot plant was opened after each run and inspected for solid deposition. The results obtained for the different runs were then compared and these results were tabulated in Table 3 below.

TABLE 3

| COMPARISON OF HYDROCRACKING RESULTS | | | | | | |
|---|---|---|---|---|---|---|
| | Case 1 | Case 2 | Case 3 | Case 4 | Case 5 | Case 6 |
| Pitch conversion, wt % | 74.4 | 77.6 | 78.3 | 79.9 | 81.2 | 81.3 |
| Sulphur conversion, wt % | 41.3 | 46.4 | 73.0 | 70.7 | 58.5 | 57.4 |
| $H_2$ consumed, gmol/kg | 5.69 | 5.85 | 7.2 | 6.73 | 7.47 | 6.68 |
| Product yield, vol. % | 100.5 | 100.4 | 103.5 | 102.1 | 100.2 | 100.4 |
| Product yield, Wt. % | 93.2 | 92.3 | 93.4 | 90.0 | 91.4 | 91.8 |
| Product specific gravity | 0.935 | 0.927 | 0.914 | 0.913 | 0.924 | 0.926 |
| Sulphur in product, wt % | 2.98 | 2.60 | 1.37 | 1.51 | 2.15 | 2.20 |
| Total solids deposit in system, g. | 1000 | 57 | — | 718 | — | 22 |

Case 1 represents a run carried out without additive and when this was shut down after 455 hours, the top quarter of the reactor was found to be full of black porous solid deposit (approximately 1000 g). Both pitch conversion and sulphur conversion dropped considerably during the run because of the reactor space taken up by the deposit.

Case 2 was a run carried out with the addition of 1 wt. % coal on bitumen and only 57 g of solid material had deposited in the reactor over the course of a 507 hour run. Both pitch conversion and sulphur conversion were the same as the initial figures for case 1.

Cases 3 and 4 signify one continuous run using a cobalt-molybdenum-alumina catalyst supported on Whitewood coal in concentrations of 2% for the first 265 hours and 0.5% for the remaining 240 hours. Desulphurization increased from 46.4 wt. % for case 2 to 70.7 wt. % for case 4, while pitch conversion increased from 77.6 wt. % for case 2 to 79.9 wt. % for case 4. However, 718 g of solids were deposited in the reactor. Examination of the reactor fluid at different stages of the run revealed a build up of considerable solid material in the reactor (up to 70 wt. % toluene insoluble material) containing considerable quantities of alumina.

Cases 5 and 6 represent a repeat of cases 3 and 4, but with the catalyst of this invention containing no alumina. Thus, the first 245 hours were run with 2 wt. % catalyst in the feed and the second 259 hours of the run were run with 0.5 wt. % catalyst in the feed. With 2 wt. % of catalyst in the feed, the pitch conversion was 81.2 wt. % and the sulphur conversion was 58.5 wt. %. Lowering the concentration of catalyst to 0.5 wt. % left the pitch conversion essentially unaltered, but caused the sulphur conversion to drop slightly to 57.4 wt. %. The sulphur conversions for cases 5 and 6 represent 41.65 and 23.71 wt. % increases over cases 1 and 2. Only 22 g of solids were deposited in the reactor at the end of these runs so that this catalyst was very effective for coke inhibition while improving sulphur removal. Moreover, the results show that a Co-Mo-coal catalyst is a superior coke inhibiting catalyst than is a Co-Mo-Al-coal catalyst.

We claim:

1. A process for hydrocracking a heavy hydrocarbon oil, at least 50 wt. % of which boils above 524° C. which comprises:

(a) passing a slurry of said heavy hydrocarbon oil and 0.01–5 wt. % of a catalyst comprising finely divided sub-bituminous coal carrying cobalt and molybdenum compounds in amounts of 0.2 to 10 wt. % Co and 0.4 and 20 wt. % Mo in the presence of 500–50,000 scf of hydrogen per barrel of said hydrocarbon oil upwardly through a tubular hydrocracking zone, said hydrocracking zone being maintained at a temperature between about 400° and 500° C., a pressure above 500 psig. and a space velocity between about 0.5 and 4.0 volumes of heavy hydrocarbon oil per hour per volume of hydrocracking zone capacity, (b) removing from said hydrocracking zone a mixed effluent containing a gaseous phase comprising hydrogen and vaporous hydrocarbons and a liquid phase comprising heavy hydrocarbons, and (c) separating said effluent into a gaseous stream containing hydrogen and vaporous hydrocarbons and a liquid stream containing heavy hydrocarbons.

2. A process according to claim 1 wherein the separated liquid stream containing heavy hydrocarbons is recycled back into the confined hydrocracking zone.

3. A process according to claim 1 wherein the slurry is moved upwardly through a tubular reactor.

4. A process according to claim 3 wherein the slurry is moved upwardly through a vertical empty column reactor.

5. A process according to claim 1 wherein catalyst carried over with the separated liquid stream containing heavy hydrocarbons is concentrated and recycled to the confined hydrocracking zone.

6. A process according to claim 5 wherein the concentrating is carried out by means of a cyclone separator.

7. A process according to claim 1 wherein the coal is a sub-bituminous coal having a particle size of less than 100 mesh.

* * * * *